US009995108B2

(12) United States Patent
Allen et al.

(10) Patent No.: US 9,995,108 B2
(45) **Date of Patent: *Jun. 12, 2018**

(54) PERMEABLE LOST CIRCULATION DRILLING LINER

(71) Applicant: Saudi Arabian Oil Company, Dharan (SA)

(72) Inventors: John Timothy Allen, Dhahran (SA); Brett Bouldin, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 10 days.

This patent is subject to a terminal disclaimer.

(21) Appl. No.: 15/139,486

(22) Filed: Apr. 27, 2016

(65) Prior Publication Data

US 2016/0237778 A1 Aug. 18, 2016

Related U.S. Application Data

(63) Continuation of application No. 13/621,927, filed on Sep. 18, 2012, now Pat. No. 9,353,584.

(Continued)

(51) Int. Cl.

| | |
|---|---|
| ***E21B 33/138*** | (2006.01) |
| ***E21B 43/10*** | (2006.01) |
| ***E21B 21/00*** | (2006.01) |

(52) U.S. Cl.

CPC ..... *E21B 33/138* (2013.01); *E21B 21/003* (2013.01); *E21B 43/103* (2013.01); *E21B 43/108* (2013.01)

(58) Field of Classification Search

CPC ..... E21B 21/003; E21B 43/086; E21B 43/108

See application file for complete search history.

(56) References Cited

U.S. PATENT DOCUMENTS

| | | | |
|---|---|---|---|
| 341,327 | A | 5/1886 | Fay |
| 2,626,779 | A | 1/1953 | Armentrout |

(Continued)

FOREIGN PATENT DOCUMENTS

| | | | |
|---|---|---|---|
| FR | 2901837 | A1 | 12/2007 |
| GB | 2395214 | A | 5/2004 |

(Continued)

OTHER PUBLICATIONS

International Search Report and Written Opinion, PCT/US2012/055474 dated Aug. 28, 2013.

(Continued)

*Primary Examiner* — D. Andrews

(74) *Attorney, Agent, or Firm* — Bracewell LLP; Constance G. Rhebergen; Keith R. Derrington

(57) ABSTRACT

A layer of permeable material is positioned on an area of lost circulation lithology in a wellbore. An example of the permeable material includes a planar member with perforations that is rolled into and retained in an annular configuration. The permeable material is lowered into the wellbore adjacent the area of lost circulation and allowed to unroll and expand radially outward against walls of the wellbore. The wellbore wall along the area of lost circulation lithology can be reamed out so the layer of permeable material is out of the way of a drill bit. Applying a bridging agent on the interface where the permeable material contacts the wellbore wall forms a flow barrier.

7 Claims, 4 Drawing Sheets

Related U.S. Application Data

(60) Provisional application No. 61/536,797, filed on Sep. 20, 2011.

(56) References Cited

U.S. PATENT DOCUMENTS

| | | | | |
|---|---|---|---|---|
| 2,944,018 | A * | 7/1960 | Borcherdt | E21B 21/003 507/117 |
| 3,134,442 | A | 5/1964 | Jennings | |
| 3,203,483 | A | 8/1965 | Vincent | |
| 3,477,506 | A | 11/1969 | Malone | |
| 5,049,003 | A | 9/1991 | Barton | |
| 5,119,862 | A | 6/1992 | Maimets | |
| 5,186,215 | A | 2/1993 | Gilleland | |
| 5,334,429 | A | 8/1994 | Moto | |
| 5,366,012 | A | 11/1994 | Lohbeck | |
| 5,375,662 | A | 12/1994 | Echols, III | |
| 5,667,011 | A | 9/1997 | Gill | |
| 5,725,328 | A | 3/1998 | Schmager | |
| 5,901,789 | A | 5/1999 | Donnelly | |
| 6,012,522 | A | 1/2000 | Donnelly | |
| 6,250,385 | B1 | 6/2001 | Montaron | |
| 6,775,894 | B2 | 8/2004 | Hardin | |
| 7,350,565 | B2 | 4/2008 | Hall | |
| 7,380,595 | B2 | 6/2008 | Wetzel | |
| 9,353,584 | B2 * | 5/2016 | Allen | E21B 43/103 |
| 2003/0015246 | A1 | 1/2003 | Hardin | |
| 2004/0055758 | A1 | 3/2004 | Brezinski | |
| 2005/0023002 | A1 | 2/2005 | Zamora | |
| 2006/0016597 | A1 | 1/2006 | Emerson | |
| 2007/0017669 | A1 | 1/2007 | Lurie | |
| 2009/0206817 | A1 | 8/2009 | Ng | |
| 2010/0032169 | A1 | 2/2010 | Adam | |
| 2010/0116495 | A1 | 5/2010 | Spray | |
| 2011/0056703 | A1 | 3/2011 | Eriksen | |

FOREIGN PATENT DOCUMENTS

| | | | |
|---|---|---|---|
| WO | 2002052124 | A2 | 7/2002 |
| WO | 20070106429 | A2 | 9/2007 |

OTHER PUBLICATIONS

International Search Report and Written Opinion dated Feb. 20, 2014, for PCT/US2012/055413.

* cited by examiner

Ax
30
24
28
10
16
14
22
12
26
24

PERMEABLE LOST CIRCULATION DRILLING LINER

CROSS REFERENCE TO RELATED APPLICATIONS

This application is a continuation of, and claims priority to and the benefit of, co-pending U.S. patent application Ser. No. 13/621,927, filed Sep. 18, 2012, which claimed priority from and the benefit of U.S. Provisional Application Ser. No. 61/536,797, filed Sep. 20, 2011, the full disclosures of which are hereby incorporated by reference herein for all purposes.

BACKGROUND OF THE INVENTION

1. Field of the Invention

The present invention relates to repairing lost circulation zones in a wellbore. More specifically, the invention relates to restoring a lost circulation zone in a wellbore with an annular member with side walls having perforations.

2. Description of the Related Art

Hydrocarbon producing wellbores extend subsurface and intersect subterranean formations where hydrocarbons are trapped. The wellbores are created by drill bits that are on the end of a drill string, where typically a top drive above the opening to the wellbore rotates the drill string and bit. Cutting elements are usually provided on the drill bit that scrape the bottom of the wellbore as the bit is rotated, and excavate material thereby deepening the wellbore. Drilling fluid is typically pumped down the drill string and directed from the drill bit into the wellbore; where the drilling fluid then flows back up the wellbore in an annulus between the drill string and walls of the wellbore. Cuttings are produced while excavating and are carried up the wellbore with the circulating drilling fluid.

While drilling the wellbore mudcake typically forms along the walls of the wellbore that results from residue from the drilling fluid and/or drilling fluid mixing with toe cuttings or other solids In the formation. The permeability of the mudcake generally isolates fluids in the wellbore from the formation. Seepage of fluid through the mudcake can be tolerated up to a point. Occasionally cracks form in a wall of the wellbore, where the cracks generally are from voids in the rock formation that were intersected by the bit. Cracks in the wellbore wall sometimes can also form due lo differences in pressure between the formation and the wellbore. Fluid flowing from the wellbore into the formation is generally referred to as lost circulation. If the cracks are sufficiently large, they may allow a free flow of fluid between the wellbore and any adjacent formation. If the flow has a sufficient volumetric flow rate, well control can be compromised thereby requiring corrective action.

SUMMARY OF THE INVENTION

Provided herein are methods of wellbore operation and a system for lining a wellbore. In one example, a method of operations in a wellbore is disclosed, where the wellbore has a lost circulation zone and includes providing a layer of material that is retained in an annular configuration. In this example the material has perforations and is disposed in the wellbore adjacent the lost circulation zone. Further in this example, the layer of material is expanded radially outward and into contact with the lost circulation zone to define a tubular member having an inner radius and an outer radius. This method can further include applying a bridging agent within the inner radius that has particles that wedge in the perforations to block flow through the perforations and form a flow barrier across the layer of material. In this example, when a pressure in a formation adjacent the lost circulation zone exceeds a pressure in the wellbore, the particles are removed from the perforations to enable flow from the outer radius to the inner radius and remove the flow barrier from across the layer of material. Further in this example, the layer of material remains in contact with the lost circulation zone. In a further optional step, pressure in the wellbore increases to above the pressure in the formation adjacent the lost circulation zone, and wherein the particles again become wedged in the perforations to reform a flow barrier across the layer of material. The method can further optionally include underreaming the lost circulation zone and/or mounting packers on opposing ends of the liner. In one example, the perforations each have a diameter that reduces with distance from the inner radius. The layer of material can in one embodiment include a planar layer that is rolled into a configuration having an annular axial cross section. Alternatively, the layer of material can be a tubular member deformed to have a reduced outer periphery to enable the step of being disposed in the wellbore and adjacent the lost circulation zone.

In another example method of wellbore operations, a wellbore liner is provided that has a tubular shape with an inner radius and an outer radius and perforations extending through a sidewall of the liner. The liner is disposed in the wellbore adjacent to where fluid flow communicates between the wellbore and a formation adjacent the wellbore. Further in this example a fluid with entrained particles is provided and a flow barrier is created across the liner by flowing the fluid through the perforations, so that the entrained particles become wedged in the perforations. Optionally, the liner can be shaped as a planar layer rolled into annular member or like a tubular member. In an alternative, flowing the fluid through the perforations includes ejecting the fluid from nozzles on a drill bit disposed in the wellbore, wherein the fluid ejected from the drill bit nozzles flows upward in the wellbore between an annular space formed by walls of the wellbore and an outer surface of a drill string on which the drill bit is mounted. In one example embodiment, the method further includes providing a second liner having perforations substantially the same size as perforations in the first liner, disposing the second liner in a second wellbore and at a location where fluid communication takes place between the second wellbore and a formation adjacent the second wellbore, providing a second fluid having entrained particles that are of a different size than particles entrained in the first fluid, and forming a (low barrier across the second liner by flowing the second fluid through the perforations in the second liner.

Also disclosed herein is a liner system for selectively blocking flow across a wall of a wellbore. In an example embodiment the liner system includes a layer of material formed into an annular shape that is selectively inserted into a wellbore and set adjacent a location where fluid communicates between the wellbore and a formation adjacent the wellbore. The system further includes perforations formed through a sidewall of the layer of material, so that when a bridging agent having entrained particles is directed into the wellbore, the particles become wedged in the perforations and block flow from the wellbore to the formation. In an example embodiment of the liner system, the particles are removed from the perforations by a flow of fluid from the formation into the wellbore. Packers may optionally be intruded on ends of the layer of material. Yet further optionally, included is an elastomeric layer on an outer surface of the layer of material for anchoring against a wall of the wellbore.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 2:
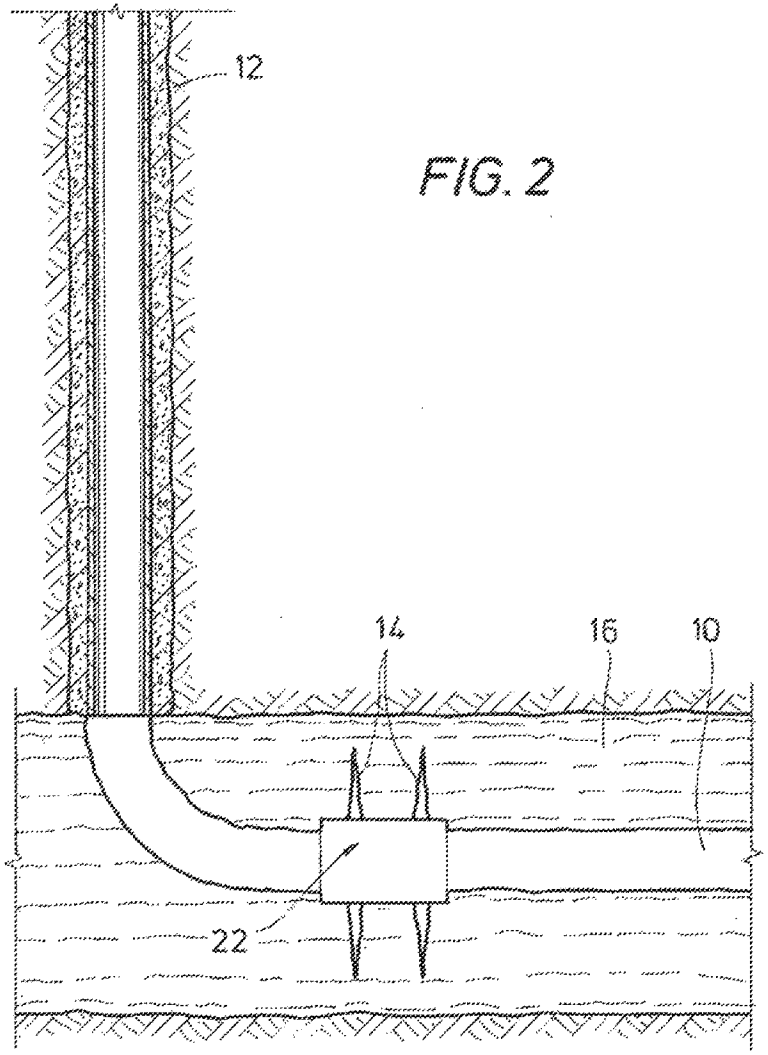
FIG. 2 is a side partial sectional view of an example embodiment of the borehole of FIG. 1 leaving a section with an enlarged diameter in accordance with the present invention.
Figure 1:
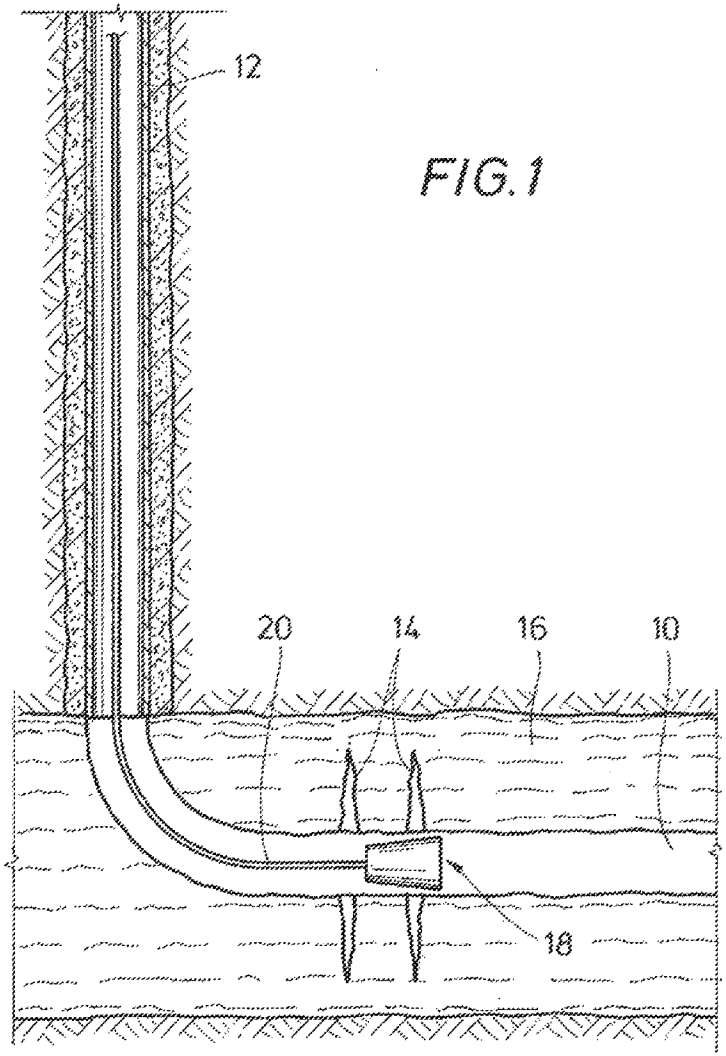
FIG. 1 is a side partial sectional view of an example embodiment of underreaming a portion of a borehole in accordance with the present invention.
Figures 3, 4:
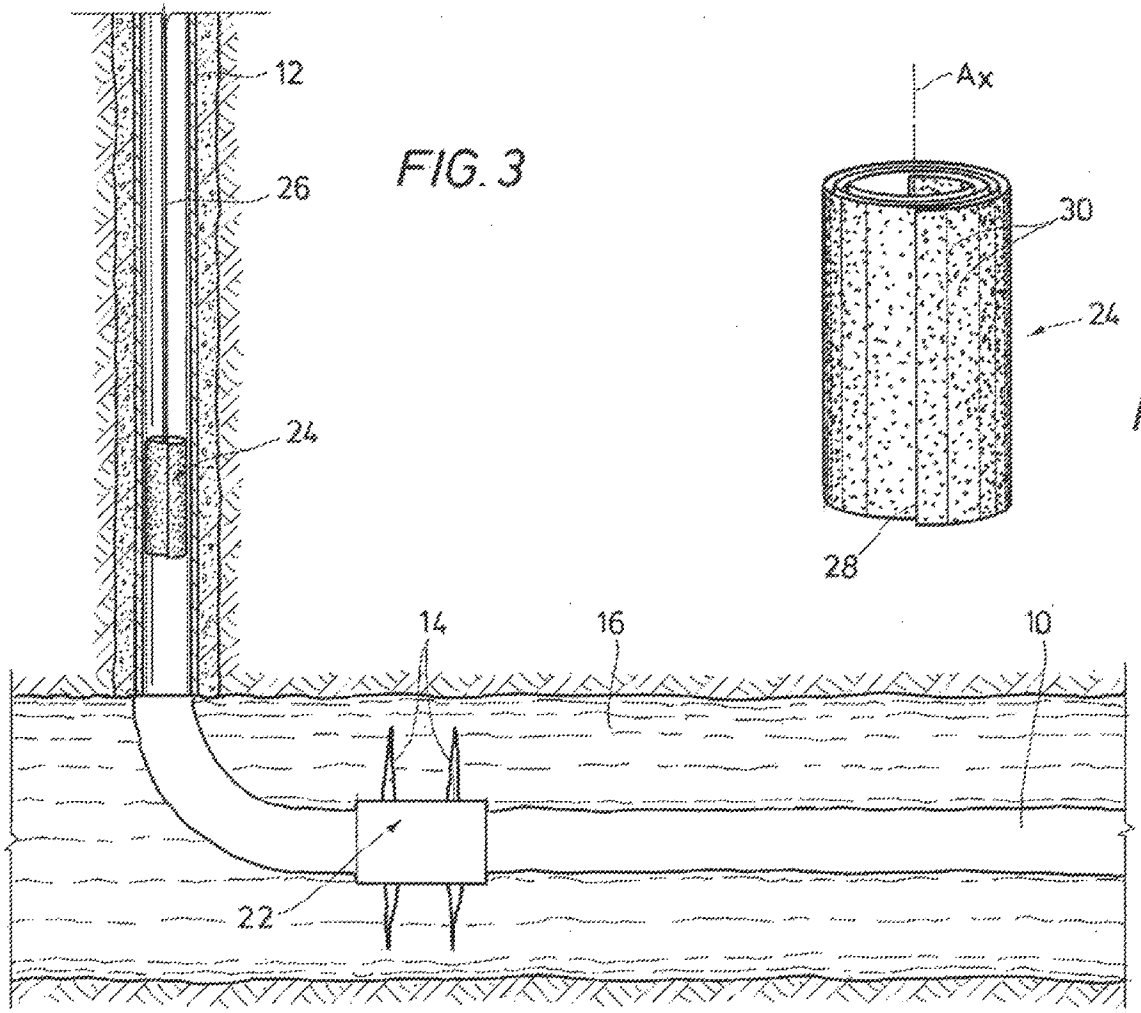
FIG. 3 is a side partial sectional view of a liner being lowered in the borehole of FIG. 2 in accordance with the present invention.
FIG. 4 is a side perspective view of the liner of FIG. 3 in accordance with the present invention.

FIG. 1 illustrates a side sectional view of an example of a wellbore 10 having a portion lined with casing 12. An unlined portion of the wellbore 10 is shown extending past a lower terminal end of the casing 12. Optionally, the entire wellbore 10 may be unlined. In the example wellbore 10, fissures 14 extend laterally from walls of an unlined portion of the wellbore 10 and into formation 16 surrounding the wellbore 10. The fissures 14 introduce fluid communication means between the wellbore 10 and formation 16 to create a lost circulation zone. In one example a lost circulation zone is defined where fluids in the wellbore 10 flow into the formation 16 and vice versa. For the purposes of discussion herein, any amount of flow between the wellbore 10 and formation 16 can be deemed to define a lost circulation zone, e.g. from seepage (detectable or not) to substantially all flow being injected into the wellbore. FIGS. 1-3 depict an example embodiment of a method for isolating the fissures 14 from the wellbore 10 to minimize or eliminate loss of circulation from the wellbore 10 to the formation 16. Referring back to FIG. 1, a drill bit 18 and drill string 20 are shown in the wellbore 10, where the drill bit 18 is suspended on a lower end of a drill string and adjacent the fissures 14. In the example of FIG. 1, the drill bit 18 can be an underreamer type.

As illustrated in FIG. 2, the drill bit 10 of the example method bit has been disposed past the fissures 14 and drawn back up the wellbore 10 while engaging the walls of the wellbore 10. This removes a portion of the formation 16 arid produces an enlarged bore section 22 adjacent the fissures 14, which has a diameter greater than other sections of the wellbore 10. Further in the example embodiment and as illustrated in FIG. 3, a liner 24 is shown being lowered into the wellbore 10 on a lower end of a conveyance member 26. Examples of conveyance members include wireline, jointed work string, drill pipe, tubing, and wiled tubing. Optionally, the liner 24 can be deployed using a tractor (not shown).

An example embodiment of the liner 24 is shown in more detail in a side perspective view in FIG. 4. In the example of FIG. 4, the liner 24 is a planar clement 28 that is wrapped or rolled into an annular configuration. Perforations 30 are illustrated formed through the planar element 28, so that even when in the rolled configuration a fluid flow path extends between an axis $A_X$ of the liner 24, through each layer making up the liner 24. and outer surface of the liner 24. As such, fluid within the liner 24 can, over time, make its way through the perforations 30 into the outer surface of the liner 24. Example liners 24 include a sheet of flexible material, a wire mesh, and any planar member that can be rolled into an annular configuration. Example materials of the liner 24 include metals, composites, and combinations thereof.

Figure 5:
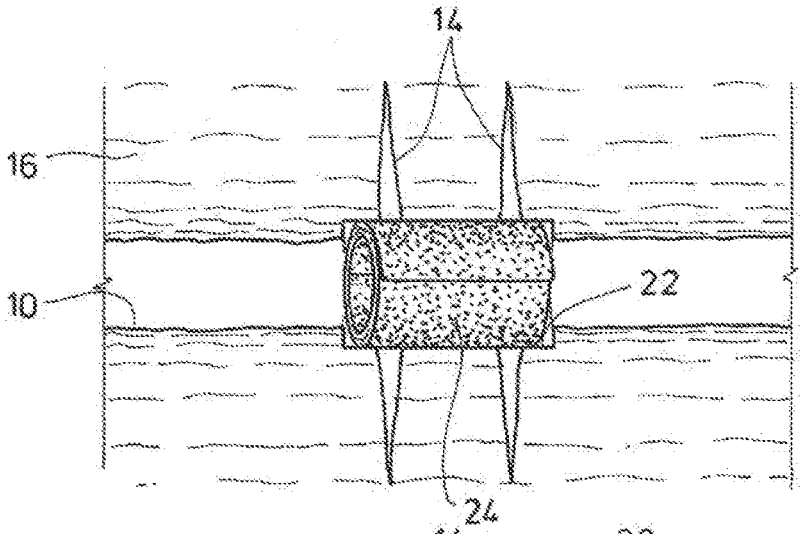
FIG. 5 is a side partial sectional view of the liner being set in the enlarged diameter portion of the borehole of FIG. 3 in accordance with the present invention.

Referring now to FIG. 5, a side partially sectional and perspective view example of the liner 24 is shown disposed within the enlarged bore section 22. In the example of FIG. 5, the conveyance member 26 (FIG. 3) has been uncoupled from the liner 24 after being used to position the liner 24 within (he enlarged bore section 22. Further in the example of FIG. 5, the liner 24 is radially expanded over its configuration of that in FIG. 3. In the example of FIG. 3, the diameter of the wellbore 10 exceeds the diameter of the liner 24 by an amount so the liner 24 can freely pass through the wellbore 10. Radially expanding the liner 24 as illustrated in the example of FIG. 5, contacts the outer surface of the liner 24 against the wall of the wellbore 10 within the enlarged bore section 22. Moreover, the outer surface of the liner 24 is set adjacent where the fissures 14 interface with the wellbore 10, thus in the path of any fluid communication between the wellbore 10 and fissures 14.

Figure 6:
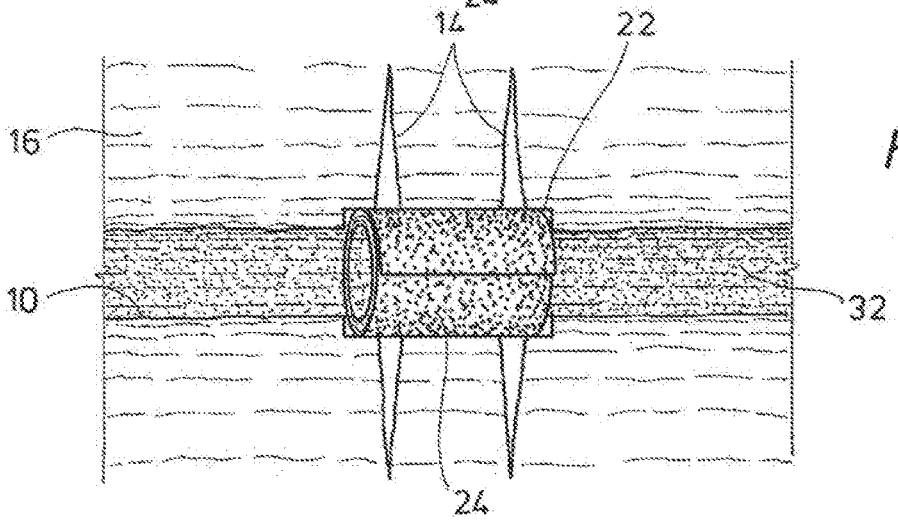
FIG. 6 is a side partial sectional view of a bridging agent being included in the borehole of FIG. 5 in accordance with the present invention.

As illustrated in FIG. 6, a bridging agent 32 may optionally be provided in the wellbore 10. In one embodiment the bridging agent 32 includes particles of a finite size and diameter that are suspended in drilling mud, or other fluid, and injected into the wellbore 10. In instances when lost circulation takes place across the enlarged bore section 22, the mud or fluid in the wellbore 10, with its entrained bridging agent 32 flows into the perforations 30 in the liner 24. In one example, the diameters of the perforations 30 are greater than diameters of the particles in the bridging agent 32. Thus the particles of the bridging agent 32 become deposited in the perforations 30 when the mud flows through the perforations 30. Over time, the particles accumulate in the perforations 30 and ultimately block fluid flowing through the perforations 30 from within the liner 24. In this manner, the bridging agent 32 forms a flow barrier across the liner 24 thereby remediating lost circulation from the wellbore 10 into the formation 16 adjacent the enlarged bore section 22. In the example of FIG. 6, the bridging agent 32 has accumulated over the area where the liner 24 interfaces with the fissures 14. In an embodiment, the presence of the bridging agent 32 on an inner surface of the liner 24 forms a mudcake or filtercake. Examples of the bridging agent 32 include calcium carbonate, suspended salt, or oil soluble resins. The bridging agent 32 can also optionally include various solids such as mica, shells, or fibers.

The combination of the liner 24 and bridging agent 32 can provide a one-way flow barrier to restrict mud loss from the wellbore 10 into the formation 16. In an example, should pressure in the wellbore 10 drop below pore pressure within the formation 16, the bridging agent 32 in the perforations 30 of the liner 24 does not block flow from the formation 16 into the wellbore 10. Instead, fluid flowing from the formation 16 and impinging the outer surface of the liner 24 can dislodge the particles of the bridging agent 32 from the perforations 30. Without the bridging agent 32 plugging fluid flow through the liner 24, the fluid exiting the formation 16 can flow through the perforations 30 and into the wellbore 10 without urging the liner 24 radially inward. Because the liner 24 is selectively permeable and allows flow from the formation 16 to pass across its sidewalls through the perforations 30, the liner 24 can remain in place when the wellbore 10 is underbalanced. This is a distinct advantage over other known drilling liners that are not permeable and are subject to collapsing m response to fluid inflow during underbalanced conditions. Embodiments exist wherein the liner 24 is set in the wellbore 10 without first underreaming, or where the liner 24 is set in the wellbore 10 in locations without fractures, cavities, or other vugular occurrences.

Figure 7:
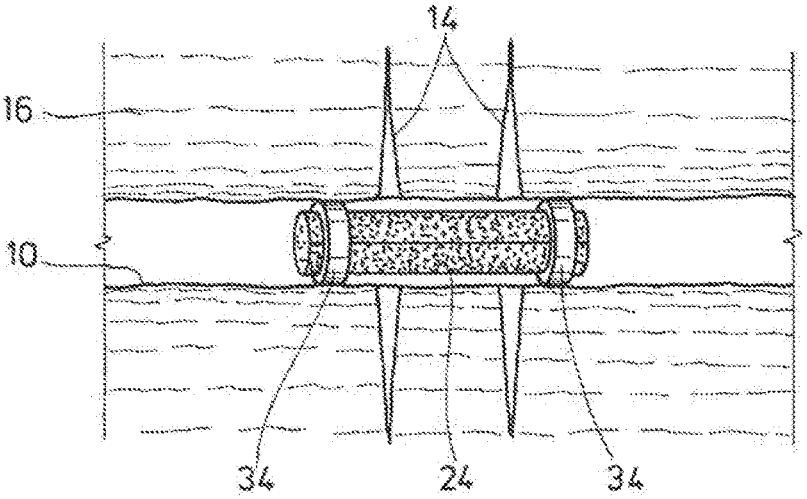
FIG. 7 is a side partial sectional view of an alternate embodiment of the liner in the enlarged diameter portion of the borehole of FIG. 5 in accordance with the present invention.

FIG. 7 provides in a side partial sectional and perspective view an alternate embodiment of the method of treating the lost circulation zone. In FIG. 7, a liner 24 is shown set in the wellbore 10 adjacent the fissures 14 in the formation 16; packers 34 are provided on ends of the liner 24. The packers 34 of FIG. 7 are strategically positioned to be on either side of the fissures 14 so that any cross-flow between the wellbore 10 and formation 16 is directed through the liner 24. The packers 34 prevent fluid from flowing along a path between the walls of the wellbore 10 and outer surface of the liner 24. By diverting substantially all cross flow between the wellbore 10 and Assures 14 through the liner 24, the packers 34 ensure a level of permability is maintained between the wellbore 10 and formation 16.

Figure 8A:
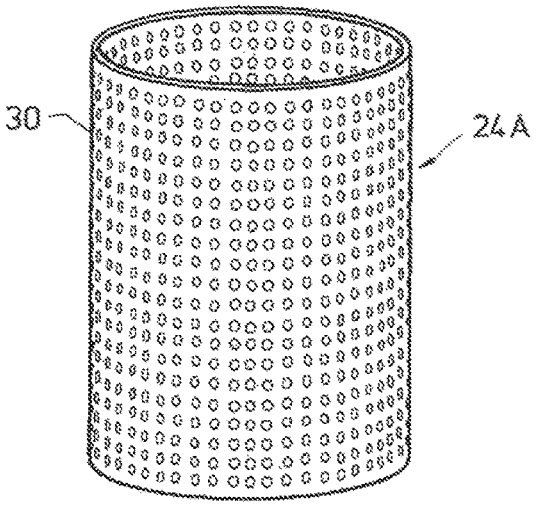
FIGS. 8A-8C are perspective and end views of alternate embodiments of the liner of FIG. 4 in accordance with the present invention.
Figure 8B:
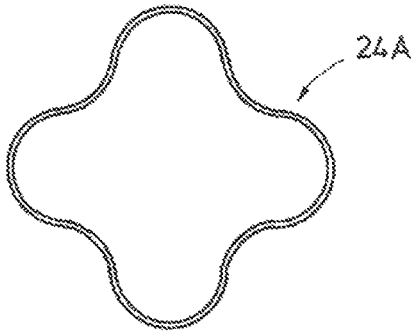
Figure 8C:
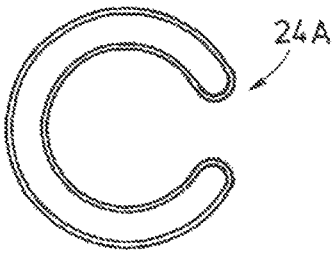

FIG. 8A provides a perspective view of an alternate embodiment of a liner 24A that is a tubular member, and may be optionally have a diameter substantially the same as the diameter of the enlarged bore section 22. Like the liner 24 of FIG. 4, the liner 24A of FIG. 8 includes perforations 30; but instead of being a wound or rolled up planar element, the liner 24A is a tubular member having a continuous outer diameter. FIGS. 8B and 8C are axial end views of the liner 24A of FIG. 8A contorted for insertion into the wellbore 10. As shown in the end view in FIG. 8B, the liner 24A can be reshaped by urging selected portions of its outer circumference radially inward. The outer periphery of the liner 24A of FIG. 8B has a star like profile. Another alternate embodiment of a configuration is shown in FIG. 8C wherein opposing sides of the liner 24A are pushed towards one another thereby flattening the cross-section of the liner 24A, and then the opposing distal ends are brought towards one another so that when viewed from the end, the liner 24A takes on a "C" shaped member. The star or "C" shaped configurations each reduce the outer diameter of the liner 24A and allow insertion of the liner 24A through the casing 12 and wellbore 10 for ultimate placement of the liner 24A into the enlarged bore section 22. After being reshaped, a retaining means (not shown) can be applied onto the liner 24A and removed when the liner 24A is adjacent the enlarged bore section 22 thereby freeing the liner 24A to expand radially outward and into position within the enlarged bore section 22. Moreover, a retaining means can also be applied to the liner 24 of FIG. 4 and removed when the liner 24 is adjacent the enlarged bore section 22.

Figure 9:
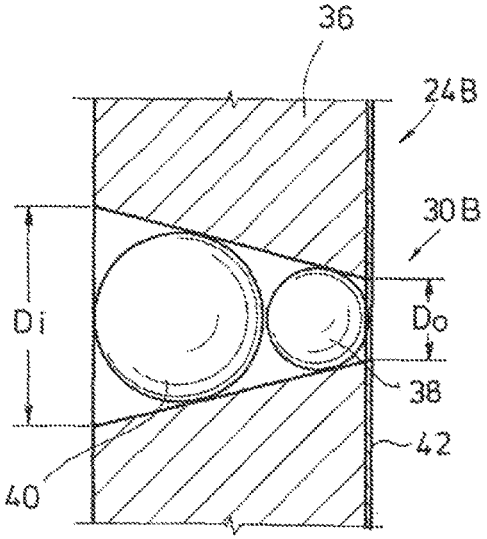
FIG. 9 is a side sectional view of an alternate embodiment of a perforation formed through a liner in accordance with the present invention.

Shown in FIG. 9 is a side sectional view of an alternate embodiment of a perforation 30B projecting through a sidewall 36 of the liner 24B. In this example the diameter of the perforation 30B slopes radially inward from a value of $D_i$ at an inner radius of the liner 24B, to a lower value of $D_o$ at an outer radius of the liner 24B. Further illustrated in FIG. 9 is that the bridging agent 32 optionally includes particles 38, 40 that have diameters of varying sizes designated for use in different wellbores having different pore distributions. In an example, the smaller sized particles 38 are designated for a first wellbore, a portion of which has a formation pore distribution that can be classified as "normal", i.e., is not vugular or highly permeable and does not include fractures, fissures, or cavities. Conversely, the larger sized particle 40 can be designated for a second wellbore with a larger normal pore distribution. In the example of FIG. 9, the diameter Do is less than the diameter of smaller particle 38 and diameter $D_i$ is greater than the diameter of larger particle 40. An advantage of $D_i$ being greater than the diameter of the larger particle 40, and $D_o$ being smaller than the diameter of the smaller particle 38, is that both sized particles 38, 40 may enter the perforation 30B from inside of the liner 24B, but cannot pass through the perforation 24B. Thus in one example of use, liners 24B with the same design and same sized perforations 30B can be used in the different wellbores having different sized pore distributions, and in conjunction with bridging agents 32 that include different sized particles, without the need to resize the perforations 30B.

In an alternate example, the wall of the wellbore 10 has zones with different sized pore distributions. In this example, the smaller particle 38 is designated for use in a smaller pore distribution in the wellbore, and the larger particle 40 is designated for a larger pore distribution in the wellbore. As such, the liner 24B of FIG. 9 is capable of forming a selectively impermeable barrier when both of the different sized particles 38, 40 are deployed in the same wellbore 10. It should be pointed out that embodiments exist wherein the bridging agent 32 includes particles having more than two different diameters, and the perforations 30B in the liner 2411 can retain the particles having more than two different diameters. Moreover, embodiments exist wherein the contour of the perforations 30B through the sidewall 36 is non-linear, instead, the contour can be stepped or curved.

Yet further optionally provided in the example of FIG. 9 is an anchoring layer 42 shown illustrated on the outer radius of the liner 24B. Examples of material for the anchoring layer 42 include conventional or fluid swellable elastomeric compounds. In this example the anchoring layer 42 is substantially pliable to facilitate anchor friction and end sealing of the liner 24B.

What is claimed is:

1. A method of operations in a wellbore having a lost circulation zone comprising:

providing a layer of material that is retained in an annular configuration and that has perforations that each have a diameter that reduces with distance from the inner radius to define a smaller diameter and a larger diameter;

disposing the layer of material in the wellbore and adjacent the lost circulation zone;

expanding the layer of material radially outward and into contact with the lost circulation zone to define a tubular member having an inner radius and an outer radius; and injecting fluid within the inner radius that has particles of a bridging agent entrained within that range in size from a smaller size with a diameter greater than the smaller diameter of the perforations to a larger size with a diameter that is less than the larger diameter of the perforations, so that when the particles collect on an inner surface of the layer of material, the particles wedge in the perforations to block flow through the perforations and form a flow barrier across the layer of material.

2. The method of claim 1, wherein the bridging agent forms a mudcake along a surface of the layer of material.

3. The method of claim 1, wherein the bridging agent comprises calcium carbonate.

4. The method of claim 3, wherein when a pressure in a formation adjacent the lost circulation zone exceeds a pressure in the wellbore, the particles are removed from the perforations to enable flow from the outer radius to the inner radius and remove the flow barrier from across the layer of material, and the layer of material remains in contact with the lost circulation zone, wherein when the pressure in the wellbore increases to above the pressure in the formation adjacent the lost circulation zone, and the particles accumulate in the perforations to reform a flow barrier across the layer of material.

5. The method of claim 1, wherein the layer of material is rolled into a tubular member, the method further comprising mounting packers on opposing ends of the tubular member.

6. The method of claim 1, wherein the layer of material comprises a planar layer that is rolled into a configuration having an annular axial cross section.

7. The method of claim 1, wherein the layer of material is a tubular member and is unfolded to have a reduced outer periphery when being disposed in the wellbore and adjacent the lost circulation zone, and which unfolds into a tubular member having an outer surface in contact with an inner surface of the wellbore.

* * * * *